US008246148B2

(12) United States Patent
Yamada et al.

(10) Patent No.: US 8,246,148 B2
(45) Date of Patent: Aug. 21, 2012

(54) LIQUID DISCHARGE DEVICE

(75) Inventors: Takahiro Yamada, Aichi (JP); Jiro Yamamoto, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 335 days.

(21) Appl. No.: 12/731,861

(22) Filed: Mar. 25, 2010

(65) Prior Publication Data

US 2011/0074849 A1 Mar. 31, 2011

(30) Foreign Application Priority Data

Sep. 30, 2009 (JP) ..... 2009-227700

(51) Int. Cl.
*B41J 2/045* (2006.01)

(52) U.S. Cl. ..... 347/68; 347/50

(58) Field of Classification Search ..... 347/68–72, 347/50, 58

See application file for complete search history.

(56) References Cited

U.S. PATENT DOCUMENTS

2005/0253883 A1 11/2005 Kato

FOREIGN PATENT DOCUMENTS

JP 2005-324453 A 11/2005

*Primary Examiner* — Julian Huffman

(74) *Attorney, Agent, or Firm* — Scully, Scott, Murphy & Presser, PC

(57) ABSTRACT

A liquid discharge device is provided with a printed circuit board. The printed circuit board is formed with a connection area where a plurality of connection terminals to be connected with a plurality of input terminals of a discharge head, and a pair of extending portions oppositely extending from the connection area, the pair of extending portions being bent with respect to the connection area to form a C-like cross section so that end portions of the pair of extending portions face each other. A plurality of positioning members configured to position the end portions of the pair of extending portions so that the end portions of the extending portions face each other, the plurality of positioning members being configured to be movable along the surface of the liquid discharge head with maintaining a positional relationship among the plurality of positioning members.

12 Claims, 8 Drawing Sheets

LIQUID DISCHARGE DEVICE

CROSS-REFERENCE TO RELATED APPLICATION

This application claims priority under 35 U.S.C. §119 from Japanese Patent Application No. 2009-227700 filed on Sep. 30, 2009. The entire subject matter of the application is incorporated herein by reference.

BACKGROUND

1. Technical Field

The following descriptions relate to a liquid discharge device configured to discharge liquid through nozzles provided thereto.

2. Prior Art

Liquid discharge devices such as an ink discharge head of an inkjet printer have been known. Typically, the ink discharge head (inkjet head) has a plurality of nozzles through which ink is discharged, and a pressure applying unit that selectively applies ink discharge pressure to the plurality of nozzles. The pressure applying unit is connected with a printed circuit board which generates a driving signal for driving the pressure applying unit.

Recently, for the purpose of faster printing speed and higher printing resolution, it is desired that the number of nozzles of such an ink discharge head is increased.

SUMMARY OF THE INVENTION

If the number of nozzles is increased, the number of wirings is increased. In order to deal with the increase number of wirings corresponding to the increased number of nozzles, there has been known a printed circuit board which has an area connected to the pressure applying unit, and a pair of extended portions which are extended oppositely from the area connected to the pressure applying unit. Then, multiple a plurality of wirings are arranged on the extended portions in a well distributed manner.

The above-described printed circuit board is configured that the pair of extended portions are formed by bending a pair of opposite ends of the printed circuit board, and a control circuit board is arranged to bridge the ends or the extended portions and connected thereto.

In order to manufacture such a unit, typically, the control circuit board is placed at a predetermined position, and the ends of the extended portions are connected in two process steps, one after another. It may be possible to reduce the number of process steps for connecting the circuit board and the printed circuit board if a positioning of the pair of extended portions is performed first, and the control circuit board is connected thereto. However, if the printed circuit board is connected to the pressure applying unit with a slight displacement with respect to a designed position, one or both of the extended portions of the printed circuit board may not be located at the positions they should be. In such a case, a positioning between the control circuit board and the extended portions may not be done successfully.

Aspects of the invention is advantageous in that an improved liquid discharge device is provided, which is configured such that the positioning of the extended portions of the printed circuit board can be done accurately even if the printed circuit board is connected with the pressure applying unit with some displacement.

According to aspects of the invention, there is provide a liquid discharge device, which is provided with a liquid discharge head including a plurality of liquid flow channels including a plurality of nozzles configured to discharge liquid, a plurality of pressure applying units configured to apply discharge pressures to the liquid inside the plurality of liquid flow channels, selectively, so that the liquid is selectively discharged from the plurality of nozzles, and a plurality of input terminals formed on a surface of the liquid discharge head. The liquid discharge device further includes a printed circuit board configured to supply drive signals causing the pressure applying units to operate, respectively. The liquid discharge head is formed with a plurality of input terminals respectively corresponding to the plurality of pressure applying units. The printed circuit board is formed with a connection area where a plurality of connection terminals to be connected with the plurality of input terminals are formed, a pair of extending portions oppositely extending from the connection area, the pair of extending portions being bent with respect to the connection area to form a C-like cross section so that end portions of the pair of extending portions face each other. A plurality of positioning members configured to position the end portions of the pair of extending portions so that the end portions of the extending portions face each other, the plurality of positioning members being configured to be movable along the surface of the liquid discharge head with maintaining a positional relationship among the plurality of positioning members.

BRIEF DESCRIPTION OF THE ACCOMPANYING DRAWINGS

DETAILED DESCRIPTION OF THE EMBODIMENT

Hereinafter, referring to the accompanying drawings, embodiments according to aspects of the invention will be described. Specifically, in each embodiment, a liquid discharge device according to aspects of the invention is provided.

Figure 1:
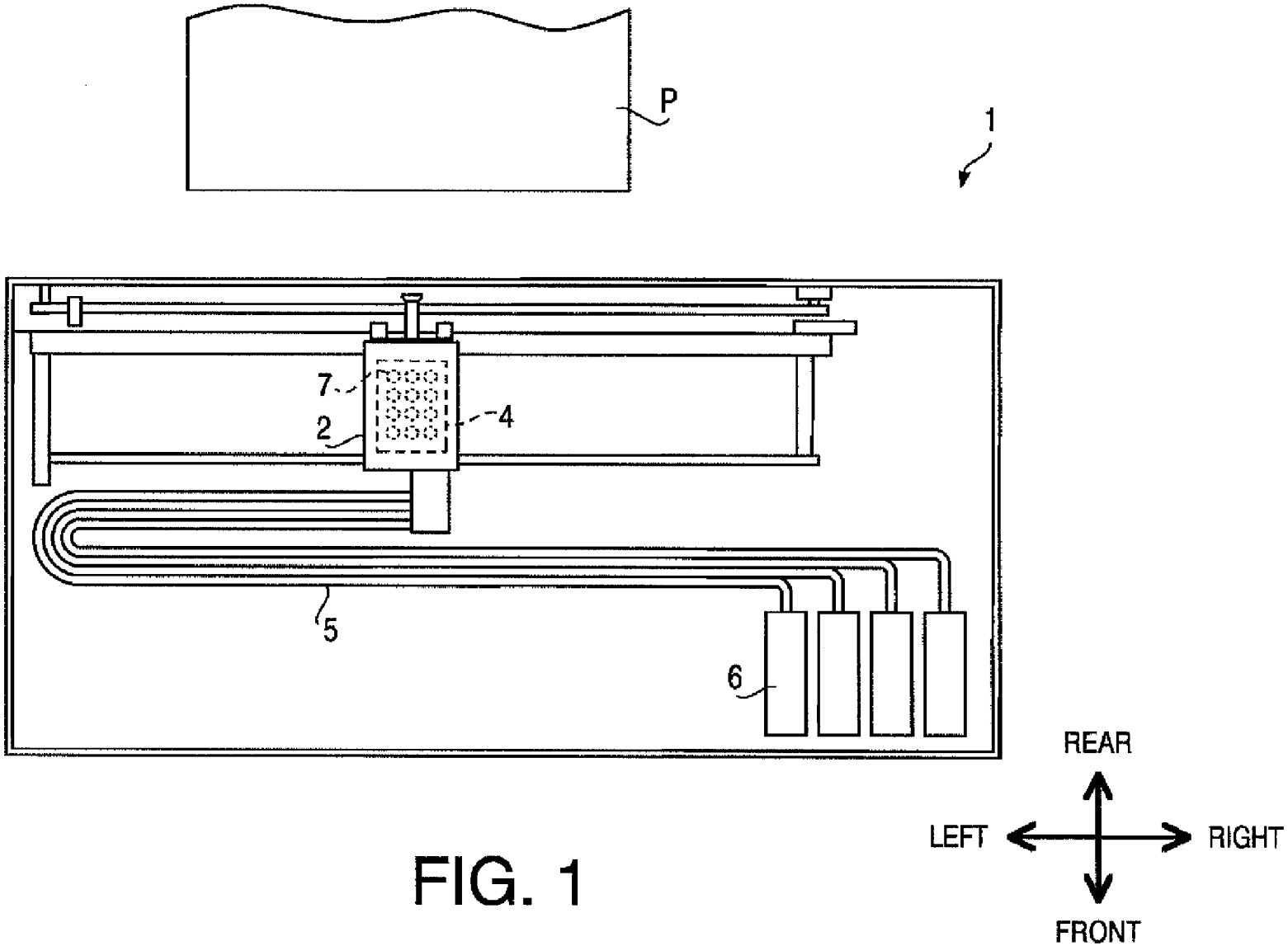
FIG. 1 is a plan view showing a schematic structure of a printer according to aspects of the present invention.

As shown in FIG. 1, a printer 1 includes a carriage 2, a guide member 3 and a head unit 4. The guide member 3 extends in a right-and-left direction in FIG. 2 and guides a right-and-left movement of the carriage 2. The head unit 4 is mounted on the carriage 2. The head unit 4 includes an inkjet head 20 and the printer 1 is further provided with four ink cartridges 6 storing ink supplied to the head unit 4, and four tubes 5 connected to the four cartridges 6, respectively, to supply the ink from the four cartridges 6 to the inkjet head 20.

The carriage 2 is slidably mounted on the guide member 3. The carriage 2 is connected to a well-known endless belt which are wound around a pair of pulleys. As one of the pulleys is driven by a motor arranged in the printer 1, the endless belt moves and the carriage 2 secured to the endless belt is driven to move, as guided by the guide member 3, in the right-and-left direction in FIG. 1.

The inkjet head 20 of the head unit 4 has multiple nozzles 72 configured to discharge yellow ink, cyan ink, magenta ink and black ink. The multiple nozzles 72 are formed on a bottom surface of the inkjet head 20. The inkjet head 20 is attached to the carriage 2 such that the bottom surface thereof face a printing sheet P when in use.

The four tubes 5 are made of flexible material such as synthetic resin. One end of each tube 5 is connected to the head unit 4, while the other end of each tube 5 is connected to corresponding one of the four cartridges 6. The four cartridges 6 store yellow, cyan, magenta and black ink, respectively, and supply the ink to the head unit 4 through the four tubes 5.

When a printing operation is performed, the printing sheet P is fed from a rear to front direction with a well-known sheet feed mechanism, while the carriage 2 is driven to move in the right-and-left direction. While the printing sheet P and the carriage 2 are moved, the ink is discharged from the multiple nozzles 72 towards the printing sheet P to print images/characters on the printing sheet P.

Figure 2:
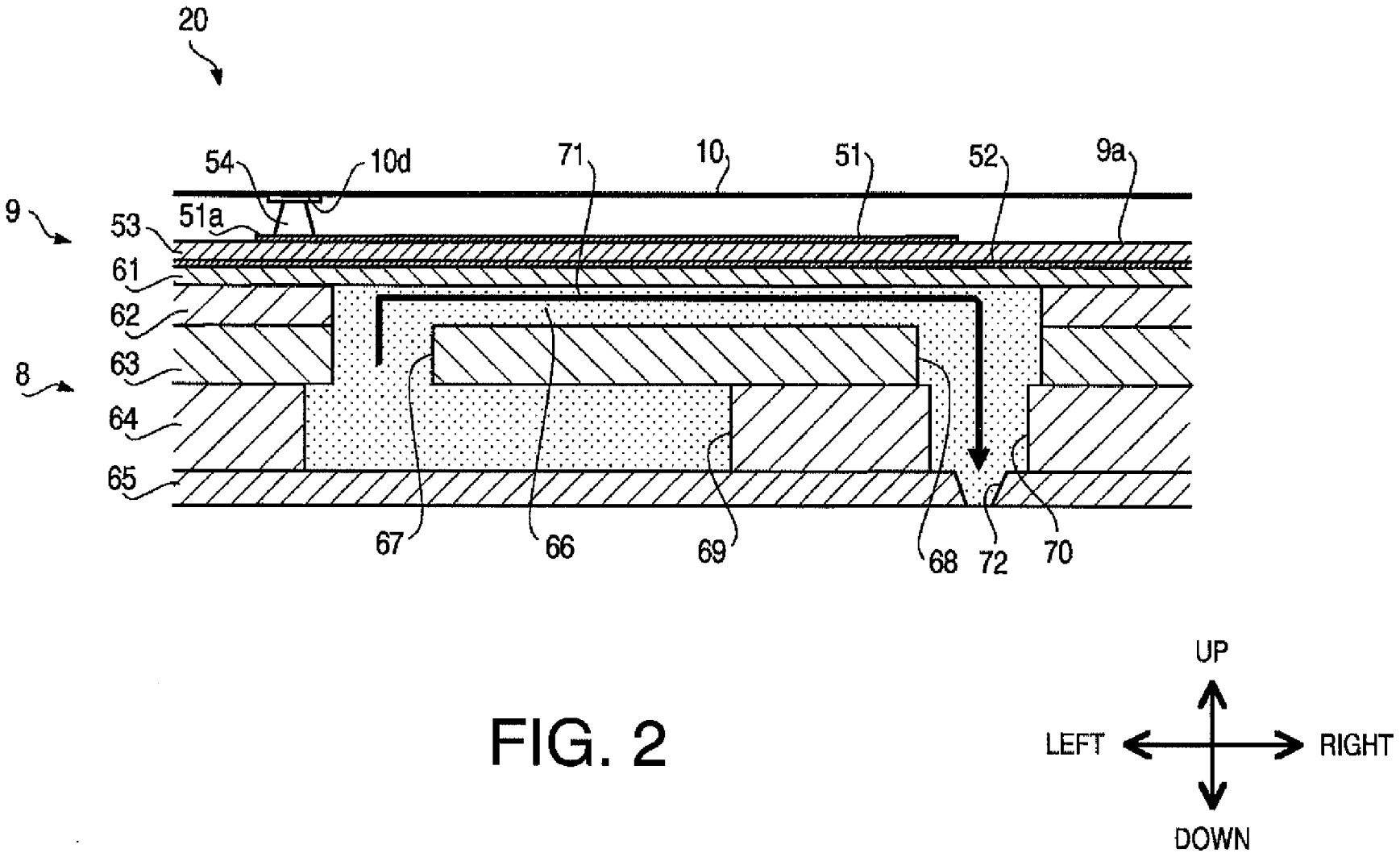
FIG. 2 is a cross-sectional side view of an inkjet head employed in the printer shown in FIG. 1.

As shown in FIG. 2, the inkjet head 20 includes a fluid channel unit 8 includes an ink flow channel 71 containing the multiple nozzles 72 (only one nozzle is shown in FIG. 2), and a piezoelectric actuator 9 configured to apply a pressure to the ink in the ink flow channel 71 to cause the ink to be discharged from the multiple nozzles 72.

The piezoelectric actuator 9 has a common electrode 52, an individual electrode 51, and a piezoelectric layer 53 sandwiched therebetween. The piezoelectric layer 53 is made of piezoelectric material mainly containing PZT (lead zirconate titanate) which is solid dispersion of lead titanate and lead zirconate, and ferroelectric substance. The piezoelectric layer 53 is polarized in an up-and-down direction along which the individual electrode 51 and the common electrode 52 are layered. At an end 51*a* of the individual electrode 51, a bump 54 (i.e., an input terminal) is formed. The common electrode 52 is connected to the ground potential. The piezoelectric actuator 9 is layered on and connected to an oscillating plate 61.

A COF (chip on film) board 10 is arranged to face the individual electrode 51 of the piezoelectric actuator 50. The COF board 10 is provided with a connection terminal 10*d* to which the bump 54 of the piezoelectric actuator 9 is electrically connected by soldering or the like.

The fluid channel unit 8 has the oscillating plate 61, a cavity plate 62, a base plate 63, a manifold plate 64, and a nozzle plate 65, which are layered and joined. Four (i.e., plates 61-64) of the five plates 61-65 are formed of metallic material such as stainless steel and the nozzle plate 65 is formed of electrically insulating material (e.g., polymer synthetic resin such as polyimide).

The cavity plate 62 is formed with a pressure chamber 66, and on the base plate 63, through holes 67 and 68, which communicate with the pressure chamber 66, are formed. The manifold palate 64 is formed with a manifold 69 and a through hole 70. The manifold 69 communicates with the pressure chamber 66 via the through hole 67. The nozzle plate 65 is formed with nozzles 72 which communicate with the pressure chamber 66 via the through holes 68 and 70. The ink flow channel 71 is formed with the through hole 67, the pressure chamber 66, the through holes 68 and 70, and the nozzle 72.

Figure 3:
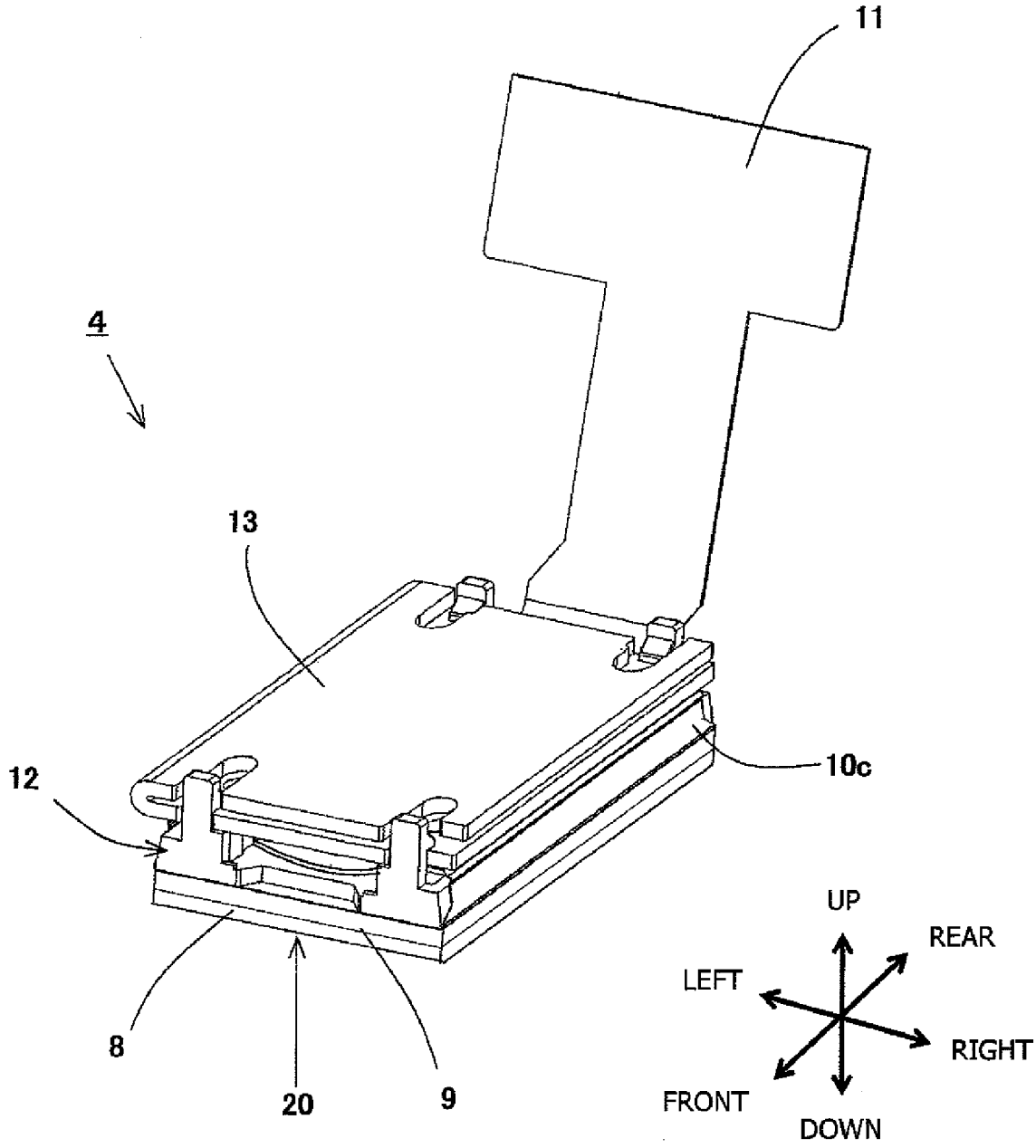
FIG. 3 is a perspective view showing a head unit of the inkjet head shown in FIG. 2.

As shown in FIG. 2, the head unit 4 includes the inkjet head 20, the COF board 10 which is electrically connected to the inkjet head 20, the FPC board 11 connected to the COF board 10, a pressure member 12 arranged on the upper surface of the COF board 10, and heat sink 13 attached to the pressure member 12 (see FIG. 3).

Figure 4:
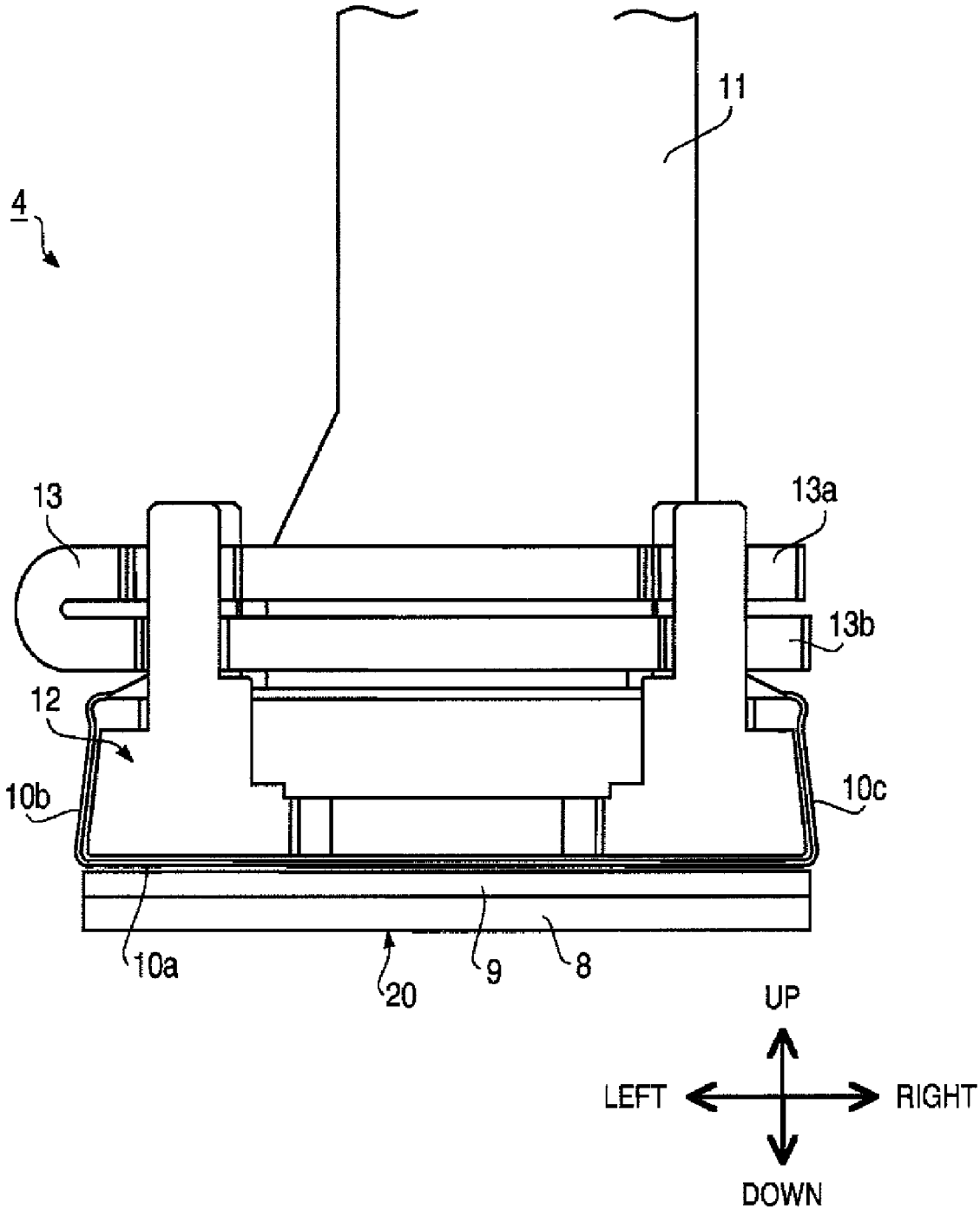
FIG. 4 is a side view showing a schematic structure of the head unit shown in FIG. 3.

The COF board 10 has a connection area 10*a* facing the piezoelectric actuator 9 and a pair of extending portions 10*b* and 10*c*, which are extended upward from the connection area 10*a* (see FIG. 4). The pair of extending portions 10*b* and 10*c* are bent along right and left ends of the pressure member 12 so as to face each other and extend onto the upper surface of the pressure member 12 to form a substantially U-shape (see FIGS. 3 and 4).

The pair of extending portions 10*b* and 10*c* are implemented with driver ICs 16*a* and 16*b*, respectively. The driver ICs 16*a* and 16*b* supply driving signals to the individual electrode 51*a* of the piezoelectric actuator 9. From the driver ICs 16*a* and 16*b*, a plurality of wirings extend toward the connection area 10*a*, and the plurality of wirings are connected to the connection terminals, respectively.

The heat sink 13 is fixed to the pressure member 112. The heat sink is made of metallic material (e.g., aluminum). The heat sink 13 has a U-shaped cross-section, as shown in FIG. 4, and has a folded portions 13*a* and 13*b* which are arranged in up and down direction. The lower folded portion 13*b* is arranged to contact the driver ICs 16*a* and 16*b*. With this structure, heat generated by the driver ICs 16*a* and/or 16*b* generates heat is radiated through the heat sink 13. Since the heat is radiated in this way, the operation of the piezoelectric actuator 9 is stabilized.

Figure 5:
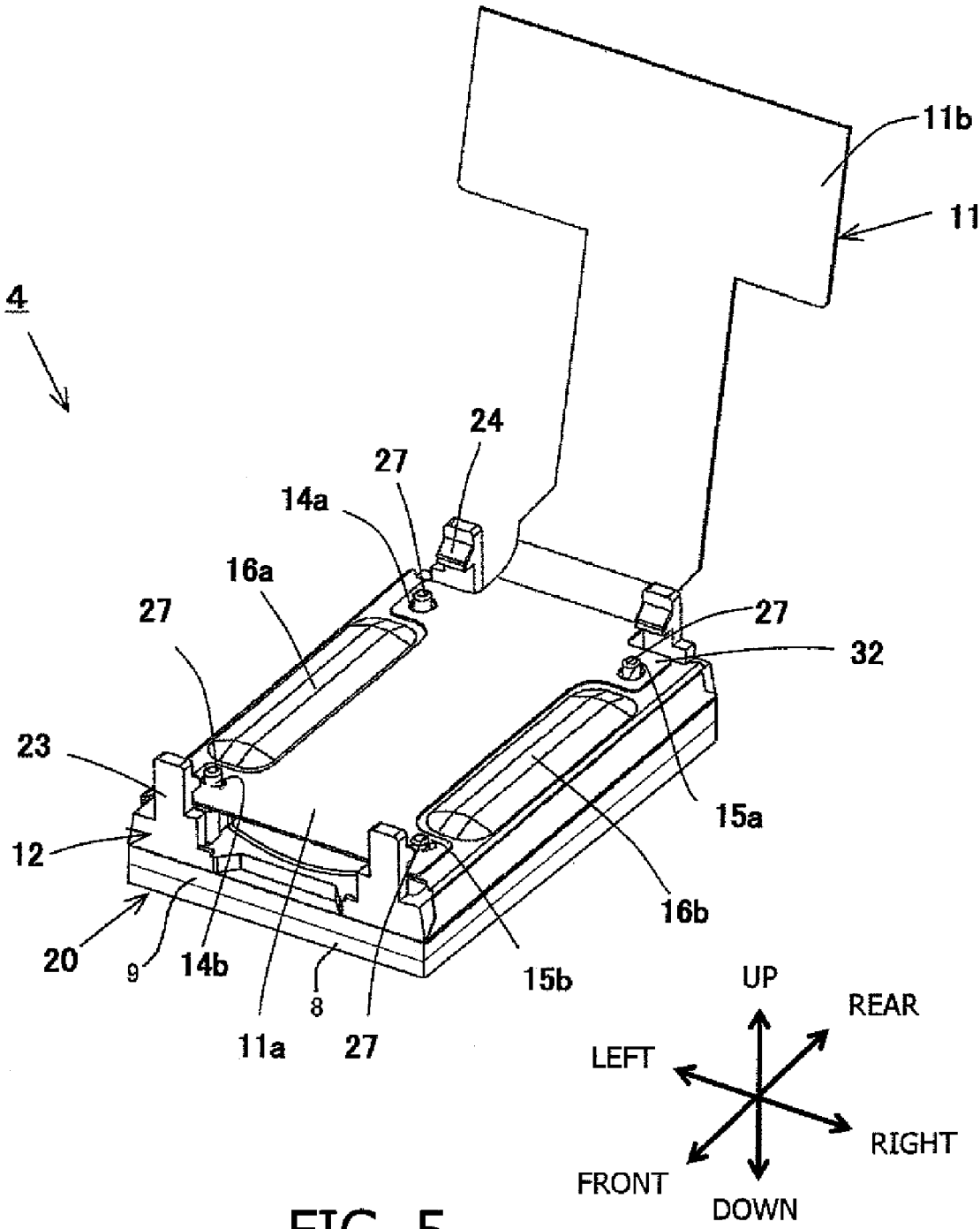
FIG. 5 is a perspective view of the head unit from which a heat sink is removed.

As shown in FIGS. 4 and 5, the FPC board 11 has an end portion 11*a*, which overlaps on the pair of extending portions 10*a* and 10*b* of the COF board 10, and connection terminals to be connected with the wirings of the driver ICs 16*a* and 16*b* are formed at the end portion 11*a* (not shown). On the other end portion 11*b* of the FPC board 11, connection terminals to be connected with a control circuit board of the printer are provided. The control circuit board is mounted on the carriage 2 (see FIG. 1) and provides control signals to the driver ICs 16*a* and 16*b*. The thus provided control signals are input to the driver ICs 16*a* and 16*b* through the wirings of the FPC board 11 and the COF board 10.

Figure 6:
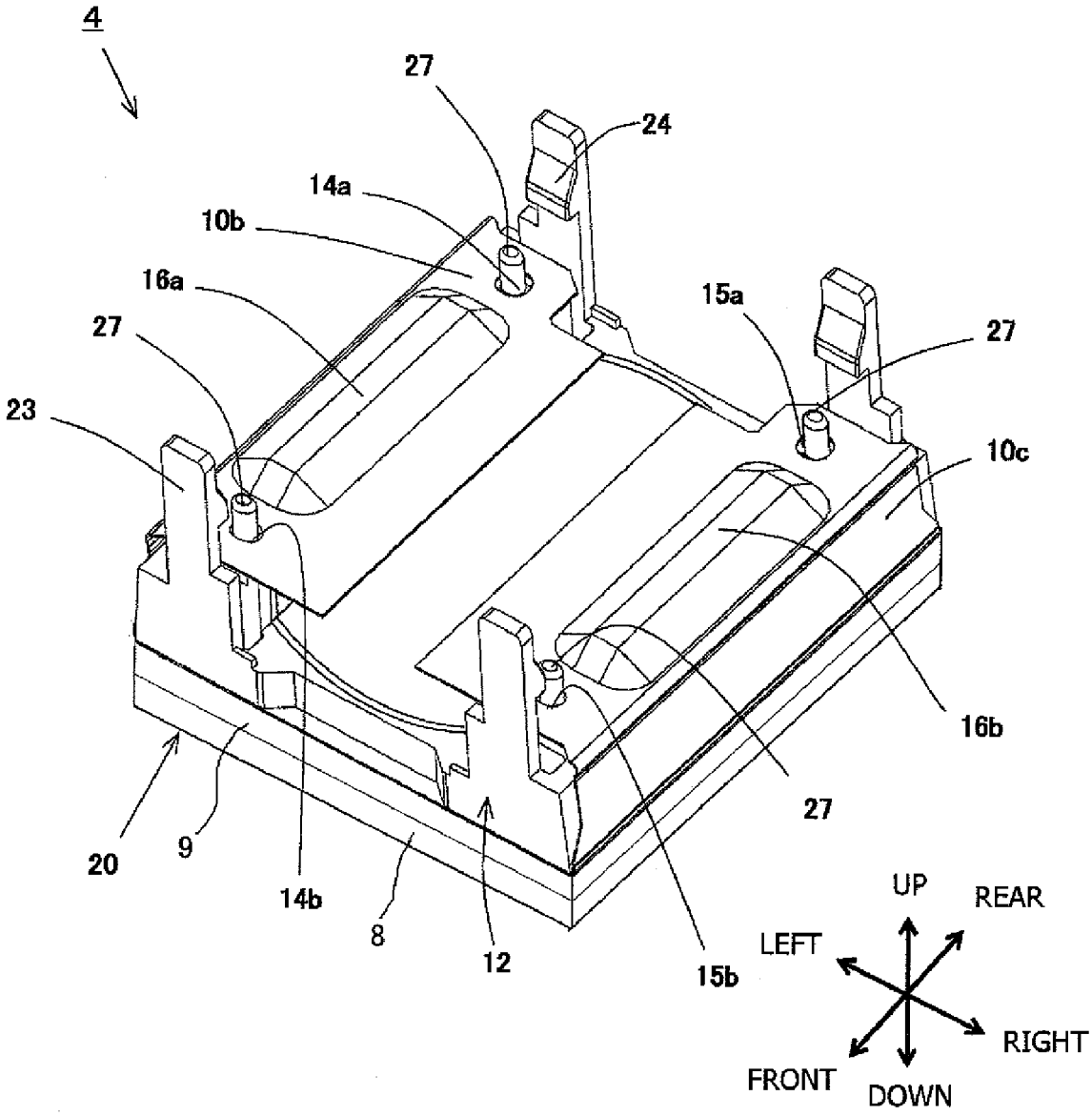
FIG. 6 is a perspective view of the head unit from which the heat sink and an FPC (flexible printed circuit) board are removed.

As shown in FIG. 6, on the extending portions 10*b* and 10*c*, through holes 14*a* and 14*b*, and through holes 15*a* and 15*b* are formed, respectively. The through holes 14*a*, 14*b*, 15*a* and 15*b* are respectively fitted on four positioning pins 27, which are protruded from the pressure member 12.

Figure 7:
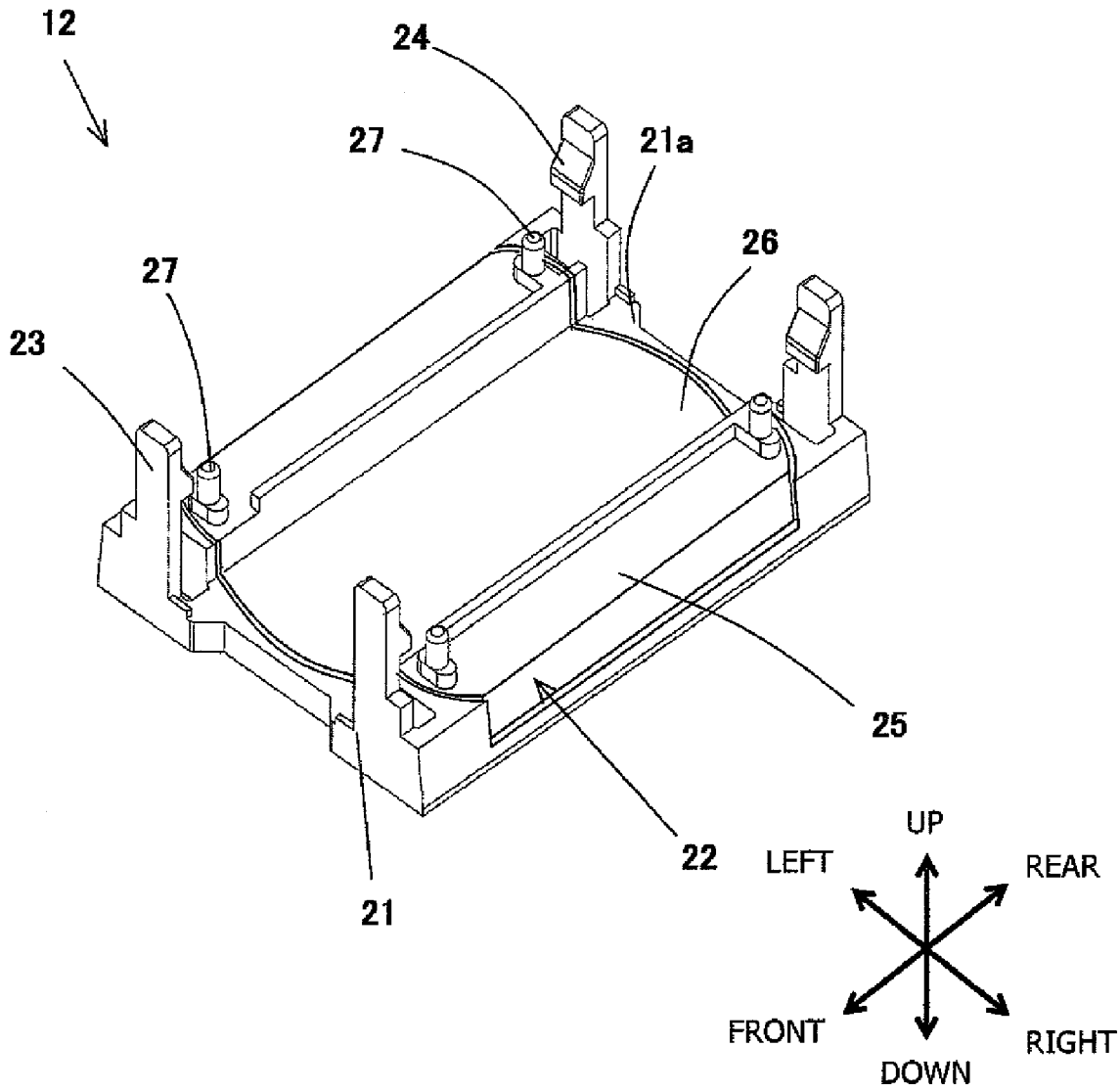
FIG. 7 is a perspective view of a pressure member.

As shown in FIG. 7, the pressure member 12 has a base 21, which has a rectangular shape when viewed from above, and a rotatable stage 22, which is rotatably (or swingably) secured onto the base 21. The bottom surface of the base 21 is mounted on the connection area 10*a* of the COF board 10. The outer size of the base 21 is substantially equal to the outer size of the piezoelectric actuator 9. Therefore, removal of the connection area 10*a* from the piezoelectric actuator 9 is effectively prevented.

At an outer end (peripheral end) of the base 21, four vertical walls 23 are provided. On inner surfaces of the vertical walls 23, wedges 24 are integrally formed, respectively. Each wedge 24 has a triangular cross-section with its upper surface being a tapered surface, and bottom surface being a horizontal surface.

The rotatable stage 22 has a pair of protruded sections 25, a recessed section 26 which is recessed with respect to the upper surfaces of the protruded sections 25, and four positioning pins 27 (see FIG. 7). In a state where the pressure member 12 is placed on the COF board 10, the protruded sections 25 are arranged along two sides of the base 21, which sides extend in a direction parallel with the width direction of the COF board 10, or a front-and-rear direction in FIG. 7.

Figure 8:
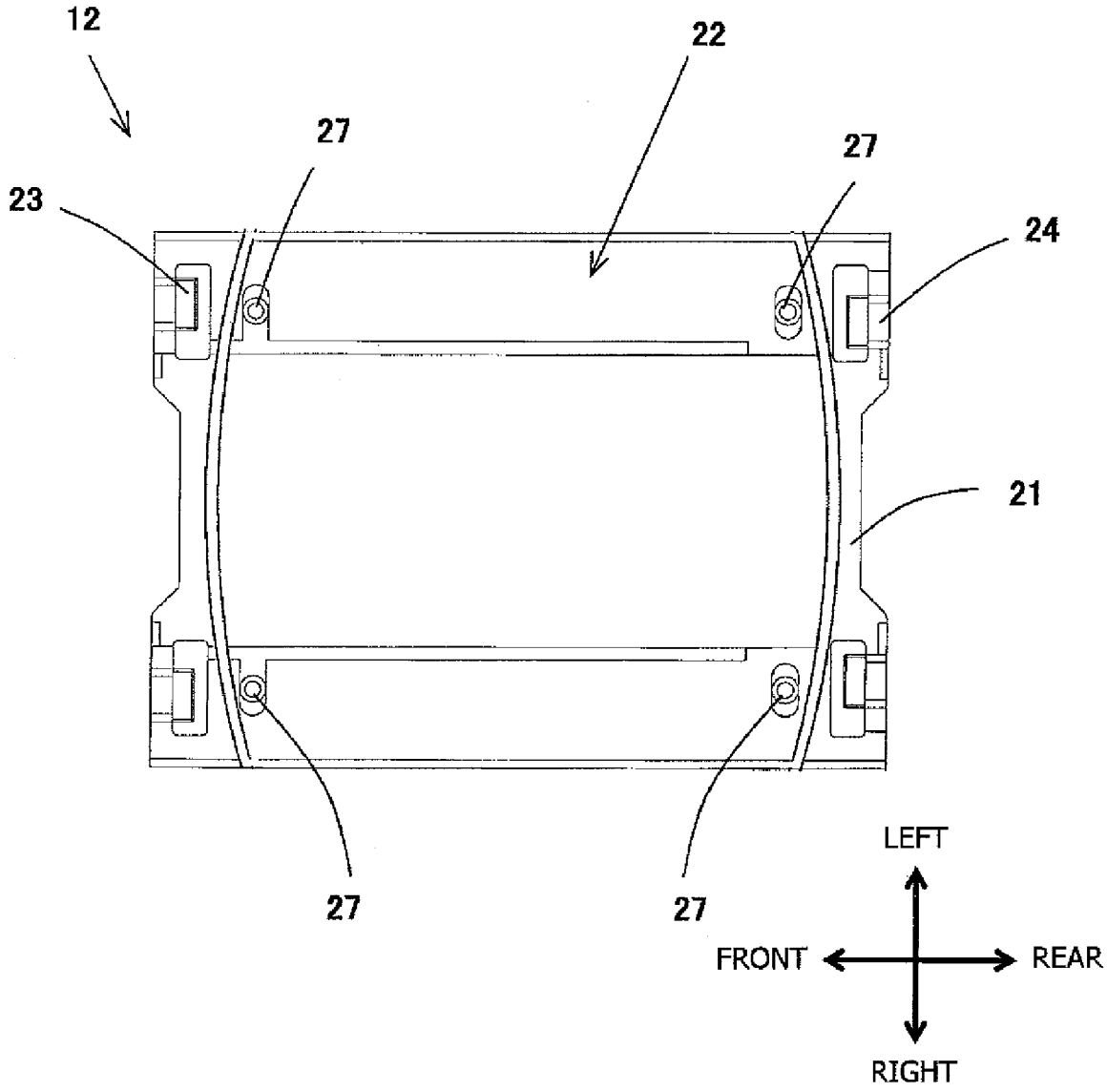
FIG. 8 is a plan view showing schematic structure of the pressure member.

The base 21 has a recessed portion 21*a*, which is slightly larger than the rotatable stage 22 in size. As shown in FIG. 8, the recessed portion 21*a* is formed such that both sides in a direction perpendicular to the direction in which the pair of protruded sections 25 extend, when viewed from a direction perpendicular to the upper surface of the recessed portion 21*a*, are arc-shaped. Further, the rotatable table 22 is also formed such that both sides in a direction perpendicular to the direction in which the pair of protruded sections 25 extend, when viewed from a direction perpendicular to the upper surface of the recessed portion 21*a*, are arc-shaped. The rotatable stage 22 is rotatably supported by a rotation shaft provided on the surface of the recessed portion 21*a*. The rotation shaft extends in a direction perpendicular to the upper surface 9*a* of the piezoelectric actuator 9. The four positioning pins 27 arranged such that two positioning pins 27 are arranged on each protruded section 25 with a predetermined distance therebetween. When the rotatable stage 22 rotates, the four positioning pins 27 rotate integrally with the rotatable stage 22 without changing positional relationship therebetween. Preferably, the rotation shaft is provided at a position where two diagonal lines defined by the four positioning pins 27 intersect. It should be noted that the rotation shaft may be omitted if a structure that allows the rotatable stage 22 to rotate substantially about an axis, which perpendicularly intersect with the upper surface 9*a* of the piezoelectric actuator 9, is provided.

With the above-described configuration, since the rotatable stage 22 is rotatably mounted on the base 21, the rotatable stage 22 can be rotated to move the four positioning pins 27 after the base 21 is connected with the COF board 17. Thus, it is possible to adjust the positions of the four positioning pins after the COF board 17 is connected with the piezoelectric actuator 9.

Next, how the COF board 10, the FPC board 11 and the pressure member 12 are attached will be described.

Firstly, the COF board 10 is connected to the piezoelectric actuator 9. Then, the pressure member 12 is connected to the COF board 10. Thereafter, the pair of extending portions 10*b* and 10*c* are pulled up on the upper surface of the pressure member 12. At this stage, the pair of extending portions 10*b* and 10*c* are held in a released state such that there remains clearances between the extending portions 10*b* and 10*c*, and the left and right side surfaces, respectively.

Then, the pair of extending portions 10*a* and 10*c* are pressed toward a both-sided adhesive tape or the like, which is adhered on the pressure member 12, using a dedicated jig. The jig is configured to have an elongated contacting portion which is longer than the width of the pair of extending portions 10*b* and 10*c*. The elongated portion has contacting areas which contact the extending portions 10*b* and 10*c*, respectively.

When the pair of extending portions 10*b* and 10*c* are connected to the left and right side surfaces of the pressure member 12, respectively, the positioning pins 27 are inserted through the four through holes 14*a*, 14*b*, 15*a* and 15*b*, so that the positioning of the pair of extending portion 10*b* and 10*c* is performed.

After positioning of the pair of extending portions 10*b* and 10*c*, the FPC board 11 is connected to the extending portions 10*b* and 10*c*.

When the COF board 10 is connected to the piezoelectric actuator 9, a positioning error might occur.

Specifically, when the COF board 10 and the piezoelectric actuator 9 are connected, positioning is performed, with use of an image thereof, in the front-and-rear direction and right-and-left direction, along the upper surface 9*a*. At this stage, the connection area 10*d* of the COF board 10 and the piezoelectric actuator 9 may be displaced in the front-and-rear direction and/or in the rotational direction with respect to the normal positional relationship therebetween, due to manufacturing error.

In particular, if the COF board 10 is displaced with respect to the piezoelectric actuator 9 in the rotational direction, the connection area 10*d* is displaced with respect to the piezoelectric actuator 9 by a certain amount in the rotational direction. However, displacement of the end portions of the extending portions 10*b* and 10*c* in the rotational direction is larger than that of the connection area 10*d*. It is because the extending portions 10*b* and 10*c* are rotated about the rotation shaft, and any point in the connection area 10 area is relatively close to the rotation shaft, while the end portions of the extending portions 10*b* and 10*c* are farther from the rotation shaft.

According to the embodiment, the four positioning pins 27 move integrally with the rotatable stage 22 and positional relationship between the four positioning pins 27 remain unchanged. Therefore, even if the COF board 10 and the piezoelectric actuator 9 are displaced from each other in the rotational direction, the four positioning pins 27 move to follow the displacement of the end portions of the extending portions 10*h* and 10*c*. Therefore, according to the embodiment, even if the COF board 10 and the piezoelectric actuator 9 are displaced from each other, the positioning between the four positioning pins 27 and the end portions of the extending portions 10*b* and 10*c* can be performed.

As described above, according to the embodiment, if the COF board 10 is arranged to be inclined in the front-and-rear direction in the drawings, by rotating the rotatable stage 22, the positions of the four positioning pins 27 can be adjusted, and thus, positioning of the pair or the extending portions 10*b* and 10*c* can be done.

Further, since the rotatable stage 22 can be moved so that the through holes 14*a*, 14*b*, 15*a* and 15*b* formed on the extending portions 10*b* and 10*c* face the four positioning pins 27, the positioning pins 27 are inserted in the through holes 14*a*, 14*b*, 15*a* and 15*b* without displacement therebetween. Therefore, no unexpected load due to the displacement will be applied to the through holes 14*a*, 14*b*, 15*a* and 15*b*.

It should be noted that the above-described is an exemplary embodiment and configuration thereof can be modified in various ways without departing from the scope of the invention. Such modifications will be described hereinafter. The elements similar to those of the above-described exemplary embodiment are given the same reference numbers as in the exemplary embodiment and description thereof may be omitted.

In the exemplary embodiment, there is provided the rotatable stage 22 which rotates with respect to the base 21 about the center of the base 21. Such a configuration may be modified such that the stage on which the four positioning pins are provided may be configured to move in the front-and-rear and right-and-left directions.

According to the above modification, the four positioning pins are movable along the surface 9*a* of the piezoelectric actuator 9, it is also easy to deal with the displacement between the COF board 10 and the piezoelectric actuator 9. Therefore, according to this modification, unexpected load will not be applied to the four through holes provided on the extending portions of the COF board 10.

According to the exemplary embodiment, the piezoelectric actuator 9 is employed as a device that applies pressure. It should be noted that the piezoelectric actuator is only an example, and any type of device can be used as far as it can apply ink discharge pressure to the ink inside the ink flow channel.

According to the exemplary embodiment, the printer is a so-called serial type inkjet printer that moves the inkjet head in the right-and-left direction, over the width of the printing sheet, to print a line of image. Such a printer is only an example and the invention can be applied to one having a line head (i.e., an inkjet head extending over the width of the printing sheet).

According to the exemplary embodiment, the printer discharges a ink on the printing sheet P. The printer needs not be limited to such a printer, but can be a printer which prints a wiring pattern by discharging conductive liquid which configures wiring patterns on a substrate. The invention can also be applied to such a printer for industrial usage.

What is claimed is:

1. A liquid discharge device, comprising:

a liquid discharge head, which includes:

a plurality of liquid flow channels including a plurality of nozzles configured to discharge liquid;

a plurality of pressure applying units configured to apply discharge pressures to the liquid inside the plurality of liquid flow channels, selectively, so that the liquid is selectively discharged from the plurality of nozzles; and a plurality of input terminals formed on a surface of the liquid discharge head, the plurality of input terminals corresponding to the plurality of pressure applying units, respectively; and a first printed circuit board configured to supply drive signals causing the pressure applying units to operate, respectively, wherein the first printed circuit board is formed with:

a connection area where a plurality of first connection terminals to be connected with the plurality of input terminals of the liquid discharge head are formed;

a pair of extending portions oppositely extending from the connection area, the pair of extending portions being bent with respect to the connection area to form a C-like cross section so that end portions of the pair of extending portions face each other;

a plurality of positioning members configured to position the end portions of the pair of extending portions so that the end portions of the pair of extending portions face each other, the plurality of positioning members being configured to be movable along the surface of the liquid discharge head with maintaining a positional relationship among the plurality of positioning members.

2. The liquid discharge device, according to claim 1, wherein the plurality of positioning members are configured to rotate about an axis which perpendicularly intersects with the surface of the liquid discharge head.

3. The liquid discharge device, according to claim 1, further comprising a pressing member configured to bias the print circuit toward the plurality of the pressure applying units, the pressing member being provided on a side opposite to a side where the connection area is defined, wherein the pressure member is provided with a swingable member that swings along the surface of the liquid discharge head, and wherein the plurality of positioning members are provided on the swingable member.

4. The liquid discharge device according to claim 3, wherein the plurality of positioning members includes a plurality of pins protruding from the swingable member in a direction perpendicular to the surface, and wherein the pair of extending portions are formed with a plurality of through holes in which the plurality of pins are to be inserted, respectively.

5. The liquid discharge device according to claim 3, wherein the swingable member is configured to be rotatable about an axis extending in a direction perpendicular to the surface so that the swingable member is swingable relative to the pressing member.

6. The liquid discharge device, according to claim 3, wherein the pressing member has a recessed portion which is formed on a surface on an opposite side of the liquid discharge head, and wherein the swingable member is rotatably fitted in the recessed portion.

7. The liquid discharge device according to claim 6, wherein the recessed portion is formed such that both sides in a direction perpendicular to the direction in which the pair of extending portions extend, when viewed from a direction perpendicular to the surface, are arc-shaped, and wherein the swingable member is formed such that both sides in a direction perpendicular to the direction in which the pair of extending portions extend, when viewed from a direction perpendicular to the surface, are arc-shaped.

8. The liquid discharge device, according to claim 3, further comprising a second printed circuit board connected with the first printed circuit board, the first printed circuit board having first terminals at the end portions of the pair of extending portions, respectively, the second printed circuit board having second terminals respectively corresponding to the first terminals, wherein a distance among the first terminals, when the positioning of the end portions is done, is smaller than a distance among the second terminals.

9. The liquid discharge device according to claim 8, wherein a portion where the second input terminals are formed has through holes in which the positioning pins are inserted.

10. The liquid discharge device according to claim 1, wherein the second printed circuit board extend in a direction perpendicular to a direction where the pair of extending portions extend.

11. The liquid discharge device according to claim 10, wherein the positioning members are located on both sides, in a direction perpendicular to a direction where the pair of extending portions extend, of the pair of driving ICs.

12. The liquid discharge device according to claim 1, wherein a pair of driving ICs, which supply driving signals to drive the pressure applying unit, are provided to the pair of extending portions.

* * * * *